US006701555B1

(12) United States Patent
Ermini

(10) Patent No.: US 6,701,555 B1
(45) Date of Patent: Mar. 9, 2004

(54) DUAL-FILLED, ADJUSTABLE POSTURAL HEALTH PILLOW

(76) Inventor: Terry Savitri Ermini, 2443 Fair Oaks Blvd., #206, Sacramento, CA (US) 95825

( * ) Notice: Subject to any disclaimer, the term of this patent is extended or adjusted under 35 U.S.C. 154(b) by 0 days.

(21) Appl. No.: 10/420,072

(22) Filed: Apr. 21, 2003

(51) Int. Cl.[7] ..... A47G 9/00

(52) U.S. Cl. ..... 5/644; 5/636; 5/640; 5/645; 5/951

(58) Field of Search ..... 5/636, 640, 644, 5/645, 911, 951, 655.4

(56) References Cited

U.S. PATENT DOCUMENTS 1,212,515 A * 1/1917 Leavitt ..... 5/636
2,805,428 A * 9/1957 Buchman ..... 5/645
3,148,389 A * 9/1964 Lustig ..... 5/645
3,411,164 A * 11/1968 Sumergrade ..... 5/644
4,768,248 A * 9/1988 O'Sullivan ..... 5/645
5,778,470 A * 7/1998 Haider ..... 5/645
5,953,777 A * 9/1999 Buck ..... 5/636
6,026,330 A * 2/2000 Chuang ..... 5/636
6,151,733 A * 11/2000 Takashima ..... 5/640
6,230,347 B1 * 5/2001 Alexander ..... 5/644

* cited by examiner

*Primary Examiner*—Alexander Grosz

(57) ABSTRACT

A postural health pillow comprising a three dimensionally rectangular outer casing which holds at least two discretely, proportionately filled casings/chambers. The bottom casing is filled with a sufficient quantity of grain hulls, or flowable particles filling, to elevate the head for proper spinal alignment for side sleeping and provide conforming support for the neck. The top casing is filled with a soft, compressible material, such as wool or down, to cushion the user's face and ear from the texture of the grain component and provide greater comfort. An aperture in the grain-filled casing allows the user to adjust the volume of fill for customizable sizing in fine increments. An opening in at least one end of the outer casing provides access for redirecting the fill in the bottom chamber to a position of maximum comfort, while in use, and fluffing the top component as required.

6 Claims, 4 Drawing Sheets

DUAL-FILLED, ADJUSTABLE POSTURAL HEALTH PILLOW

BACKGROUND OF THE INVENTION

The present invention relates to a dual-filled, adjustable postural health pillow construction that combines an adjustable conforming support element with a cushioning comfort element to provide a pillow that fits the user precisely and can be configured to support the preferred sleep position. Included in this invention is a double-chambered pillow comprising a grain-filled or other appropriate flowable-particles component in the bottom chamber and a soft, compressible-fill component in the top. The grain-filled chamber, a cloth casing, has a zipper or hook and loop aperture that allows the user to adjust the volume of fill for a customizable fit. It further allows the grain fill to be refurbished as needed. In the preferred embodiment, the chambers, discreet cloth casings, are held together in designated position within an outer bag body that is three dimensionally rectangular with at least one opening in the shorter end. The present invention maximizes the benefits of each of its discreet fillings while simultaneously eliminating their undesirable actions by proportioning the volume of fills anatomically and relationally, by pairing them in top/bottom order in an ergonomically shaped configuration, and by allowing adjustment of the amount of filling.

Grain-filled pillows have been used for centuries to provide proper postural alignment for the body, as generated by their superior ability to conform precisely to the position of the head and neck and to keep the head steadily elevated and in alignment with the neck and spine throughout the night. A major complaint with traditionally constructed, prior art grain-filled pillows is the rough texture of the grains against the face. A second complaint is that when sleeping on the side, these pillows are uncomfortably hard against the user's ear. Therefore, the present invention positions a selectively filled soft compressible-fill component on top of the grain-filled component comprising enough volume and density to negate the complaints but not in an amount that would inhibit the responsiveness of the grain or flowable-particle filling beneath.

A second reason that traditionally constructed grain-filled pillows feel hard against the ear is due to their knife-edged construction, which produces a mound in the center whereby the greatest volume of filling, hence the greatest firmness, is posited directly under the ear. The proportional filling and three dimensional casing of the present invention resolve this problem by presenting the head with a level bed of grains/hulls in a quantity that allows room for displacement within the casing when the head nestles into the pillow. This means less fill under the ear and preconditions the formation of a deeper head "crater" in the grain filling to hold the head steady in its aligned position.

A third complaint with traditionally constructed and filled grain/hull pillows is that in commonly sold sizes they lack a sufficient volume and height to provide correct alignment for side sleeping positions. Within a normal size range, according to shoulder width, the user requires approximately 4"–5.5" of pillow height to elevate his head, keep his neck straight, and hold his head, neck and spine in alignment for side sleeping. Most commercially sold buckwheat hull pillows provide only 2.5"–3.5" of pillow height which is sufficient for back sleeping, but insufficient for side sleeping. The present invention provides pillow heights of 4"–5.5" which can be adjusted down to 2.5"–3.5."

Traditional, single bodied compressible-fill pillows with luxury fills like pure fluffed wool, feather and down, or synthetic fibers are used for their superior resilience and softness. They resolve the problem of a grainy texture against the face but fail to keep the head elevated, losing significant loft under the weight of the head and continuing to compress throughout the night. In failing to keep the head elevated at an optimally aligned position, they can contribute to restless sleep as well as neck, shoulder and back pain. Essentially the traditional bag-of-fluff, mounding pillow design has the wrong technology. It provides the greater volume of filling under the head where it is least needed and the lesser volume of filling at the edge where much more filling is required to support the neck. Its cross-sectional shape is almond or oval—similar to that of the head's. When "firm" or very full this type of pillow tips the head up, causing the neck to bend up, (FIG. 7.) Pillows that are "medium" or "soft" tip the head down, also causing the neck to bend down, (FIG. 8.) To provide steady support, a pillow's shape needs to compliment the shape of the head and neck, not be similar to it. Therefore, the preferred embodiment of the present invention discloses a boxed construction holding two compliant fillings which allow the user's head to remain level and comfortably cradled with an ample amount of the filling flowing into the neck edge for complete cervical support, (FIG. 6.)

Recognition of the inadequacy of traditional pillows led to the production of contoured foam (discussed in U.S. Pat. No. 6,230,347), and pre-formed, temperature sensitive or memory pillows, which are shaped appropriately to provide more pillow height at the neck edge and less in the middle to accommodate the user's head. However, they are contoured according to generalized measurements that never exactly match the individual user's dimensions. For instance, a user with a short neck would be unable to get his head over the neck cylinder and rest in the central cavity. The conforming filling of the present invention that molds exactly to the user's contours is an improvement.

Additionally, preformed foam pillows have 4"–5" of cylindrically shaped foam at the neck edge and 2" of foam comprising the concave area under the head. An average 13 lb. head sinks easily into the thinner foam whereas the neck lacks sufficient weight or strength to compress the thick neck cylinder proportionately. Since foam seeks to return to its original form when compressed the cylindrical neck support can be experienced as aggressive, exerting an uncomfortable pushing sensation against the neck. Grain fillings, on the other hand, displace when the user's head rests on the pillow, molding up and around the head, and moving into the periphery to form a neck bulge that conforms to the neck to passively cradle the neck and hold it straight without exerting pressure. Additionally the foam neck edge cylinder is not able to bend around the shoulder and mold to the user's side-sleeping position, whereas the grain filling is user compliant and moves in all directions simultaneously. Yet another reason grain filling is superior is that it can be removed or added to to adjust pillow height whereas foam materials cannot.

Furthermore, because foam doesn't breathe it generates heat around the head—a condition less healthy than one which provides ventilation around the head, as does the grain filling. Additionally, visco-elastic foam is considered unhealthy, especially for persons with chemical sensitivities, because of the unpleasant and potentially toxic fumes that out gas from this polyurethane based material. Since grain-filling, especially the organic grain filling of the preferred embodiments of the present invention has greater moldability than visco elastic foam, is adjustable, and is free of toxic trace chemicals, it is an improvement over the prior art of contour and memory foam pillows.

Several uniquely designed pillows, each disclosing a top and a bottom chamber filled with discreet fillings have been patented, but their designs and utility are surpassed by the present invention which provides greater ergonomic function, more adjustability for the individual's size and sleep preferences, by virtue of the extremely compliant, passively moldable filling and the fact that the pillow height, which is ample for side sleeping, can be reconfigured by removing a sufficient quantity of the grain filing for back sleeping. The present invention is also superior for its ease of manufacture, simplicity of use, and ease of cleaning all parts. Its construction from all-natural, eco-friendly materials renders it a healthier choice and in the preferred embodiment it is hypo-allergenic and suitable for people with chemical sensitivities.

Lustig (U.S. Pat. No. 3,148,389) discloses a pillow that has a top and bottom chamber that are filled with a soft, compressible-fill component and closed. The firmness of the pillow is adjustable by inserting rectangular slabs of a "relatively hard foam" material. This construction regulates pillow height in the increments of the thickness of the foam slabs, not in the minute increments of the present invention. To get a pillow height of 4"–5.5" would require a plurality of inserted slabs and result in a pillow that was very hard under the ear and not at all conforming under the head or at the neck edge.

Sumergrade (U.S. Pat. No. 3,411,164) discloses a pillow comprised of three chambers, to keep the preferred filling from shifting to the periphery of the pillow when in use. The present invention recognizes the importance of adequate filling shifting to the periphery for total neck support. Sumergrade's pillow is adjustable by insertion of an air filled bladder for the purpose of increasing firmness and volume to enable the pillow to be used as a backrest while reading, not for adjusting pillow height for sleep comfort and/or spinal alignment, such as the present invention.

O'Sullivan (U.S. Pat. No. 4,768,248) discloses a pillow in which the top chamber is filled with soft filling and the bottom chamber holds a cylindrical roll shape component made of a firm material such as hard latex or tightly packed polyester. This neck support member is "slidably moveable" within the bottom chamber. Since this pillow's cylindrical component is not balanced by another firm element positioned at the top of the head the user's head would not stay level. During the night the top of the user's head would tip downward as the thinner soft layer would compress, causing the neck to bend over the "hard" cylinder. The fact that the cylinder is specified as "hard" increases the likelihood that the user would experience discomfort from this element. Additionally, using this pillow in a pillowcase would reduce the ease of sliding the cylindrical member during the night, rendering a difficult laundering situation. The present invention forms a natural neck cylinder when the grain filling, displaced by the user's head moves to the periphery in the space afforded by the boxed construction. It conforms exactly to the user's dimensions, is compliant, and supports gently without the potential for discomfort, being softened by the top compressible-fill layer. The head is elevated steadily during sleep by grain filling. A pillowcase does not restrict its function.

Chuang (U.S. Pat. No. 6,026,330) uses a compressible filling, citing foam or polyester fiber, in the bottom chamber and buckwheat hulls mixed with far-infrared imparting particles in the top. This design intends to keep the user's head from touching the mattress, stating that a problem with buckwheat hull pillows is that the buckwheat hulls typically move to either side of the head causing a bare spot in the middle where the head sinks down, thereby making contact with the mattress. A bottom foam/fiber layer is placed underneath the hulls chamber to keep the head elevated to avoid contact with the mattress.

The described scenario is unrealistic and could occur only when the buckwheat hull pillow described contains too small a volume of hulls relative to the size of the casing, or tick. For any pillow to function properly there is a necessary proportional relationship between the volume of filling and the interior space of the pillow casing. In order to elevate the head 4"–5.5" for proper spinal alignment for adult side sleeping, grain-filled pillows with a casing measuring 21"× 14" require 5–6 pounds of filling. For back sleeping the head needs to be elevated 2.5"–3.5" and requires 3.5–4.5 pounds of fill for a 21"×14" casing. Within these guidelines, there is no possibility of the hulls moving to the sides of the head or allowing contact with the mattress in a sufficiently filled pillow. The average human head weighs about 13 pounds. A level amount of buckwheat hulls, contained in an 8"×8"×3" casing can support a 15 pound bowling ball 2.5" above the resting surface. Whereas an 8"×8"×3" layer of medium density foam or fiberfill would compress down to less than and inch under the weight of the bowling ball, allowing virtual contact with the mattress. Buckwheat hulls and grain fillings keep the head elevated. For this reason they are optimally positioned on the bottom of any dual chambered pillow, not on the top as in the patent being discussed, which uses the exact reverse positioning of compressible and grain fillings as used in the present invention. Chuang's invention does not shield the face from the grainy texture of the buckwheat hulls as does the present invention.

Haider (U.S. Pat. No. 5,778,470) discloses a pillow that incorporates small expanded beads therein which can move relative to an outer polyurethane foam shell to adapt to the configuration of a person's head and neck. It comprises a top and bottom chamber, selectively filled with polystyrene beads, and contained within an inner polyurethane foam shell. The design restricts the movement of the beads within their respective compartments.

This construction uses the same fillings in each of the two evenly sized chambers. The present invention uses two discrete, synergistic fillings in proportionately filled chambers. Additionally, one of this patent's stated objectives is to have the configuration of a typical elongated pillow, a construction discussed in terms of traditional, mounding pillows above that can cause the head to tilt and the neck to bend, especially in the side sleeping position. Furthermore, there is no adjustability of the volume of beads. Haider calls for the use of all synthetic materials which can generate heat around the head as well as have an out-gassing factor considered by some in the health field to be undesirable for one's health.

Takashima (U.S. Pat. No. 6,151,733) comprises a plurality of different shapes and sizes of pillows to insert into a set of 3 casings according to the desired support and sleep position, determined by a mathematical formula. It is customizable only in relationship to the placement of the pillow layers which themselves are not adjustable. Buck (U.S. Pat. No. 5,953,777) discloses a plurality of pillow layers that have varying heights and firmness, such that height and firmness are not functionally connected. The ease of a single pillow makes the present invention more practical and efficient in both use and manufacture. Since the present invention allows the adjustment of the volume of the granular filling, it is customizable to fractions of an inch, providing a greater degree of customization than selective pillow layers.

BRIEF SUMMARY OF THE INVENTION

A pillow's shape and dimensions, the compliancy and perceived comfort of its fill/filings, the capacity of its supportive function to establish and maintain proper spinal alignment, and its ability to be adjusted to the individual user are the most important features contributing to deep, restful, sleep. The Dual-Filled, Adjustable, Postural Health Pillow comprises two discretely and proportionally filled chambers in at least one three dimensionally rectangular casing. The chambers are held together in a top/bottom order. The bottom is filled with grain-filling, or other suitable flowable particles, to elevate the head and conform to the user's contours, and can be opened to adjust the volume of filling. The top is filled with a soft, compressible fill such as fluffed wool, feather and down, or other suitable soft fillings, to provide cushioning for the face and ear and overall comfort.

The very nature of the flowable conforming grain filling makes the present invention more adjustable than a pillow with any other filling because it flows freely within the space between the mattress and head, adjusting fully to the user's preferred position, molding precisely to the head and neck. Even without opening the chamber to change the volume of grain filling, the present invention is adjustable to a greater height by turning the pillow on its side, or to a more comfortable configuration by manipulating the filling manually from the surface of the bottom chamber so as to direct the flowable filling either toward the head and neck for increased support or toward the back and sides for a reduction of pillow height. Both of these actions can be achieved simply and easily in the middle of the night. The added ability to remove or add grain-filling makes the pillow's height and firmness adjustable within very fine increments.

Another important consideration in making an improved pillow is the effect on the health of the materials used. The preferred embodiments of the present invention comprise organically grown cotton fabric for the casings, organic grain hulls for the bottom chamber, and pure washed wool for the top chamber. Wool is a natural insulator that wicks moisture from night sweats and inhibits dust mites which are repelled by lanolin. Foam pillows are made of polyurethane and out gas low level toxic fumes.

It is an object of the present invention to provide a pillow that establishes and maintains exact, proper postural alignment.

It is yet another object of the present invention to provide sufficient elevation and support for the head in the side sleeping position while at the same providing the feeling of soft cushiony, comfort.

It is yet a further object of the present invention to provide the benefits of a grain-filled pillow without the customary hardness against the face and ear such pillows engender.

It is yet another object of the present invention to provide a pillow that is adjustable giving the user the experience of a perfect-fit in both side and back positions.

It is yet a further object of the present invention to provide a double chambered pillow wherein the soft component can be refluffed.

It is yet another object of the present invention to provide a pillow, all parts of which can be easily cleaned.

It is another object of the present invention to provide a pillow, the preferred embodiment of which uses all natural filling and casing materials that breathe and keep the head ventilated and the user protected from exposure to any trace chemicals.

The characteristics and advantages of the invention are further sufficiently referred to in connection with the accompanying drawings which represent at least one embodiment. Other embodiments can achieve the same results. Variations and modifications of the present invention will be obvious to those skilled in the art and it is intended to cover in the appended claims all such modifications and equivalents. The entire disclosure of all references, applications, patents and publications cited above are hereby incorporated by reference.

DETAILED DESCRIPTION OF THE DRAWINGS

Figure 1:
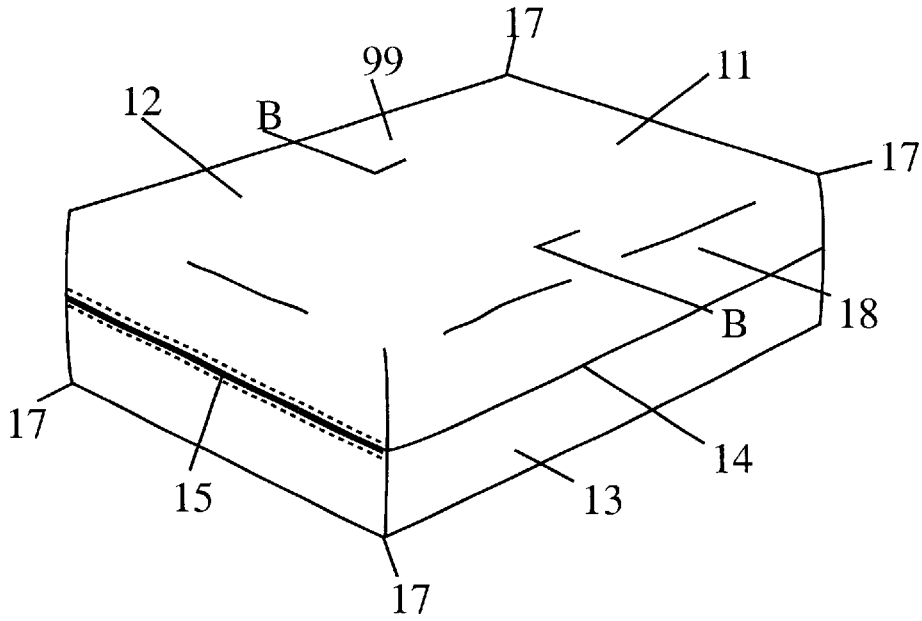
FIG. 1 is a schematic representation of a preferred embodiment of the Dual-Filled, Adjustable, Postural Health Pillow showing the outer casing enveloping the two filled chambers inside.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose. I contemplate the employment of any structures or arrangements that are properly within the scope of the appended claims.

FIG. 1 shows an embodiment of the adjustable postural health pillow 99. Bag body 11 is constructed with two rectangular walls 12 and 13, made of such suitable pillow fabric such as organic cotton, cotton, cotton blends, silk, linen, hemp, fleece, velour, etc. and attached, by common fastening of fabric such as sewing, along the two long sides at seam line 14. Opening 15 on at least one of the short ends of the bag body 11 is formed by hemming and abutting the short end of walls 12 and 13. (Optionally the opening 15 can be closeable with a zipper.) All four corners 17 are mitered to form a three-dimensionally rectangular inner chamber 18, which contains at least two filled casings/chambers 21 and 24, inserted through opening 15. Opening 15 further enables the user to reach her/his hand between the two filled casings/chambers to either fluff the top and/or to manipulate and redirect the hulls in the bottom to a position which supports maximum comfort.

Figure 2:
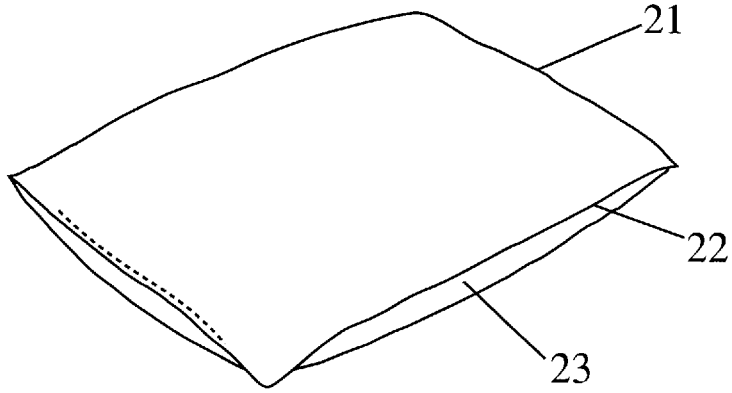
FIG. 2 is a schematic representation of the second filled chamber comprising the soft component which is inserted to occupy the top position.

FIG. 2 shows filled casing/chamber 21, constructed of rectangular walls 22 and 23, made from such suitable pillow ticking as organic cotton, standard cotton, or synthetic blend fabric and attached around the perimeter by common fastening of fabric such as sewing, filled with soft filler 19 and stitched closed. The soft filler material is preferably one of the following: pure fluffed wool, goose or duck down, various feather and down mixtures, organic fluffed cotton, silk fiber, corn fiber and its blends or other suitable compressible fill. Casing/chamber 21 is positioned to be on top when inserted into the bag body 11.

Figure 3:
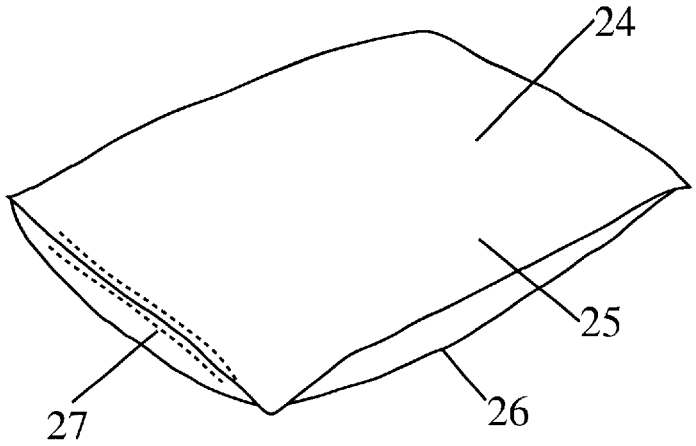
FIG. 3 is a schematic representation of the first filled chamber comprising the grain-like, support component which is inserted to occupy the bottom position.

FIG. 3 shows filled casing/chamber 24, constructed of walls 25 and 26 made of suitable pillow ticking material such as organic cotton, standard cotton, or synthetic blend fabric and attached around the perimeter by common fastening of fabric such as sewing to include an aperture 27 is filled with displaceable fill, 20, preferably millet, buckwheat, spelt or rice hulls, various seeds, wood beads or shavings, or appropriate other flowable particles filling. The aperture 27, closeable by hook and loop or zipper, allows the user to customize the level of granular filling to her/his preference. Casing/chamber 24 is positioned to be on the bottom. Because these filled casings/chambers are oversized in proportion to bag body 11, they "box" themselves naturally when put inside the boxed casing 11 without the need for each of their corners to be mitered.

Figure 4:
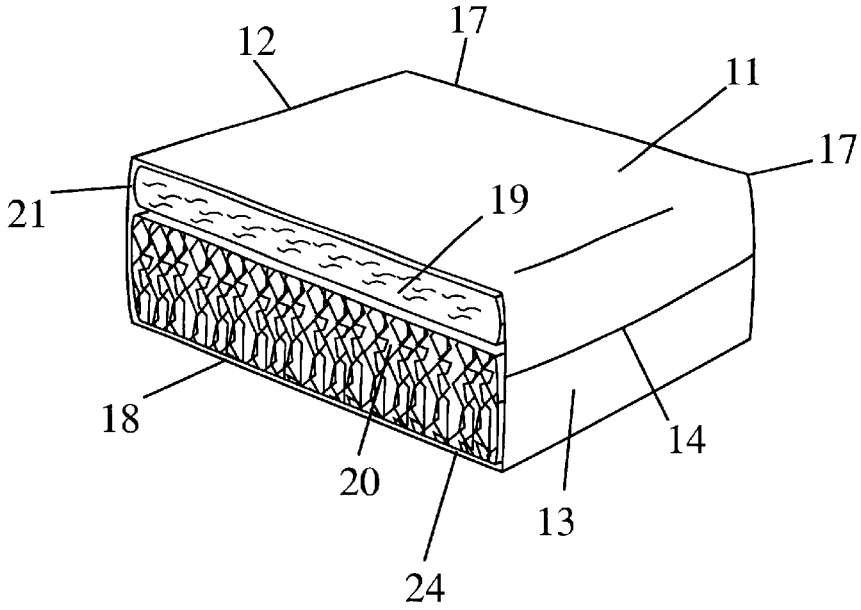
FIG. 4 is a schematic sectional representation of FIG. 1 along the lines B—B.

FIG. 4 depicts a cross-section of pillow 99 along the lines B—B. The top filled chamber 21 holds a measured amount of soft filler 19, proportionally less voluminous than the grain-filling in chamber 24. Only a light layer of soft fill is required to protect the user from the texture of the grain-filling and impart a feeling of cushiony comfort. Too thick or dense a top layer would inhibit the responsiveness of the grain filling. A most common sleeping position, which requires the head to be elevated 4"–5.5" above mattress for postural alignment. Back sleepers can remove a sufficient amount of filling 20 to make the pillow ergonomic for their needs of 2.5"–3.5" of pillow height. To increase pillow height more filling 20 can be added through the aperture, and/or a booster layer of latex foam can be inserted in chamber 18 under the grain-filled casing. Alternatively a flat magnetic or other therapeutic pad can be inserted in chamber 18.

Figure 5:
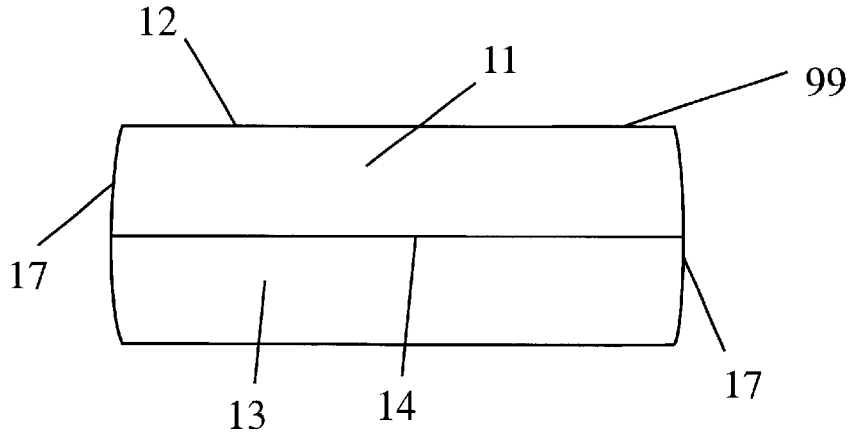
FIG. 5 is a schematic representation of an eye level end-view of pillow 99.

FIG. 5 depicts the eye level, end-view of pillow 99.

Figure 6:
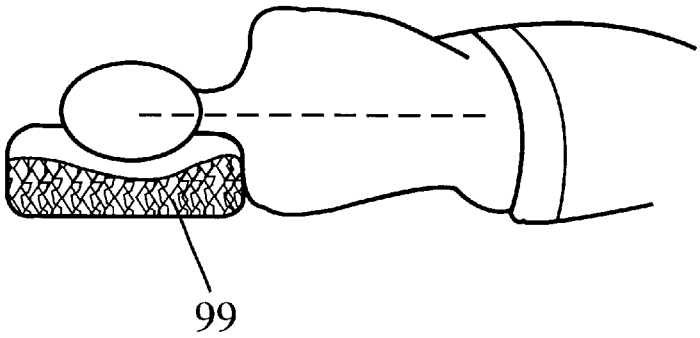
FIG. 6 is a schematic representation of a cross-section of the pillow 99 in FIG. 1 in use.

FIG. 6 depicts a cross-sectional view of the present invention in use, showing how the ergonomic postural pillow 99 holds the head up in alignment with the spine and conforms to the user's contours to provide total neck support.

Figure 7:
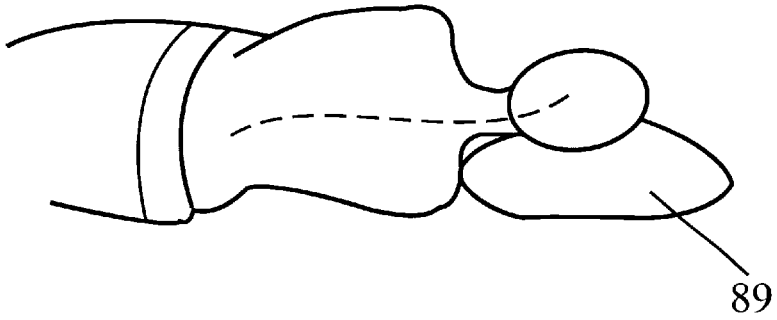
FIG. 7 is a schematic representation of a cross-section of a traditionally constructed overstuffed pillow 89 in use.

FIG. 7 depicts an overstuffed, traditional pillow 89 in use and shows how it tilts the head up causing the neck to bend.

Figure 8:
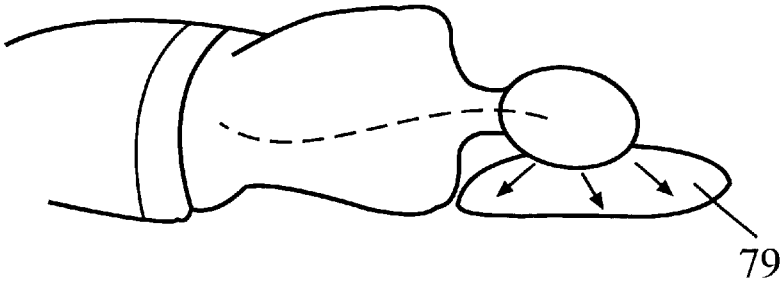
FIG. 8 is a schematic representation of a cross-section of a traditional under stuffed pillow 79 in use.

FIG. 8 depicts a under stuffed traditional pillow 79 in use and shows how it fails to hold the head up causing the neck to bend down.

Figure 9:
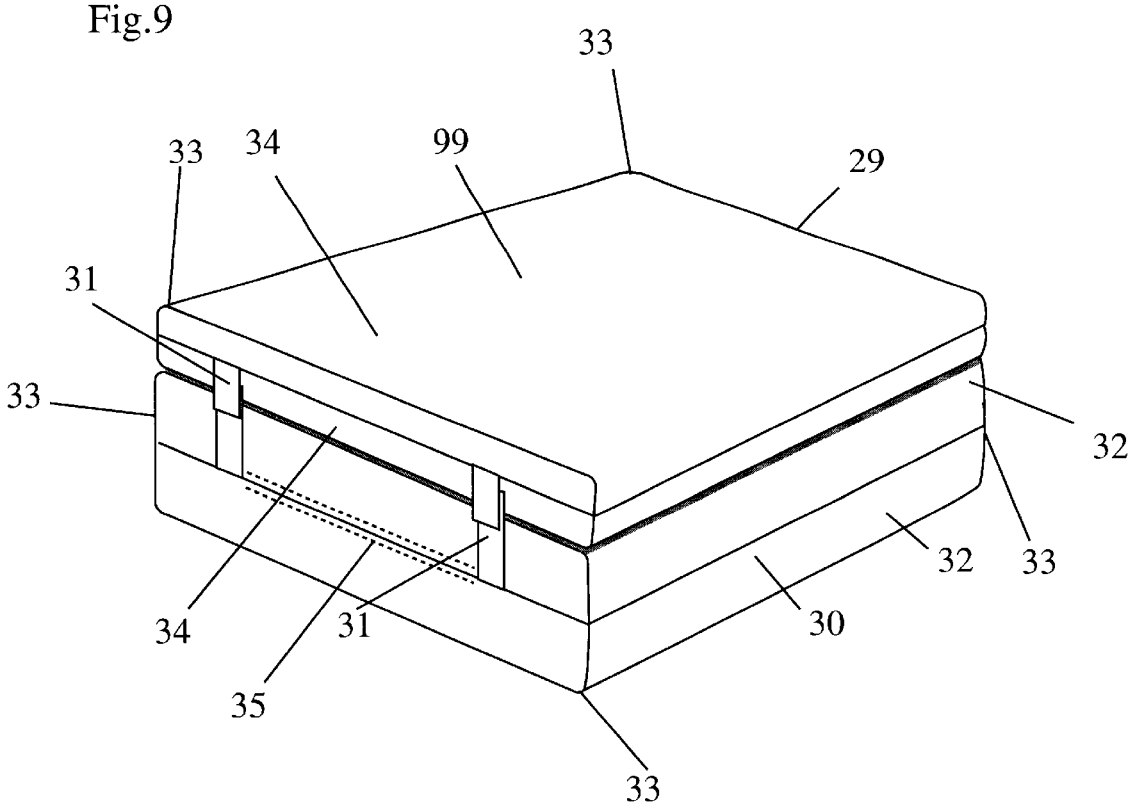
FIG. 9 is a schematic representation of an alternative embodiment of A Dual-filled, Adjustable, Postural Health Pillow.

FIG. 9 depicts another embodiment of pillow 99 comprising two discretely filled casings 29 & 30 held in a top/bottom configuration, respectively, with four tabs 31 sewn into the end seams that are fitted with male/female connectors such as snaps, hook and loop, or buttons. Casing 29 is constructed from paired walls of suitable pillow fabric 34, such as organic cotton, standard cotton, silk, linen, hemp, fleece, terry velour, etc., and attached, by common fastening of fabric such as sewing, along the periphery. All four corners 33 are mitered. Casing 29 is filled with soft, compressible filling, preferably pure fluffed wool, goose or duck down, various feather and down mixtures, organic fluffed cotton, silk fiber, corn fiber and its blends, or other suitable pillow fillings. Casing 30 is constructed from paired walls of suitable pillow fabric 32, such as organic cotton, standard cotton, silk, linen, hemp, fleece, terry velour, etc., and attached, by common fastening of fabric such as sewing, along the periphery. All four corners 33 are mitered. An aperture, 35, closable with hook and loop or zipper, is positioned in one end wall seam, and allows the volume of fill to be adjusted to the user's preference. The overall shape of the pillow is optionally square or rectangular.

What is claimed is:

1. An improved head supporting pillow construction having a height between 2.5 inches and 5.5 inches comprising:

at least two discretely, proportionately filled inner cloth casings/chambers of rectangular shape such that a selected order of top and bottom position is maintained;

a selectively measured, flowable particle, conforming filling component inside the cloth casing/chamber of the bottom position, wherein the volume of said filling is adjustable by means of a single aperture in the casing;

a selectively measured, compressible filling component inside the cloth casing/chamber designated for the top position, wherein said casing is sewn closed; and a three dimensionally rectangular, fabric bag body encasing the two discretely filled casings/chambers.

2. The pillow of claim 1 wherein said bag body comprises at least one opening for insertion or removal of the filled cloth casings/chambers; and wherein the at least one opening allows access to manipulate the casings/chambers for reconfiguring them; and wherein said opening is closeable with a zipper.

3. The pillow of claim 2 wherein the bag body dictates configuration of the pillow fillings as to provide a level, non-mounding surface to receive the head.

4. The pillow of claim 3 wherein the cloth casing/chamber that is filled with a flowable, conforming filling component has at least one aperture that is closeable by hook and loop or zipper to render the volume of filling adjustable by either adding or removing a selected amount of said filling.

5. The pillow of claim 4 wherein the bag body allows for the insertion of a relatively flat addendum such as a latex foam slab or a magnetic pad.

6. The pillow of claim 1, wherein the flowable particle filling comprises grain hulls.

* * * * *